United States Patent [19]

Moore

[11] Patent Number: 4,907,358

[45] Date of Patent: Mar. 13, 1990

[54] SNOWBLADE ASSEMBLY

[75] Inventor: Thomas S. Moore, Northville, Mich.

[73] Assignee: Detroit Innovative Products, Northville, Mich.

[21] Appl. No.: 397,544

[22] Filed: Aug. 23, 1989

[51] Int. Cl.[4] ..... E01H 5/06

[52] U.S. Cl. ..... 37/232; 37/231; 37/270; 37/273

[58] Field of Search ..... 37/231, 232, 266, 270, 37/272, 273, 276

[56] References Cited

U.S. PATENT DOCUMENTS

| | | | |
|---|---|---|---|
| 2,468,950 | 5/1949 | Wiedman | 37/273 X |
| 3,587,751 | 6/1971 | Schmidt | 37/232 X |
| 4,369,590 | 1/1983 | Miller | 37/231 |
| 4,843,744 | 7/1989 | Jansen | 37/232 |

*Primary Examiner*—Randolph A. Reese
*Assistant Examiner*—Arlen L. Olsen
*Attorney, Agent, or Firm*—Harness, Dickey & Pierce

[57] ABSTRACT

A snowblade assembly is disclosed which is mechanically mounted to a motor vehicle in substantially the same manner as the original bumper and which has a snowblade which is moveable between a forwardly extending pointed position and a generally planar position. The snowblade is attached to the vehicle by a four bar linkage assembly having tubular telescoping portions therein and which is partially contained within box housing members. A pair of springs are also used to normally bias the snowblade in a perpendicular position relative to the traversed ground.

13 Claims, 4 Drawing Sheets

SNOWBLADE ASSEMBLY

BACKGROUND AND SUMMARY OF THE INVENTION

This invention relates to a snowblade assembly and more particularly to an assembly which allows a snowblade to be mounted to a vehicle in substantially the same manner as the vehicle bumper and which is mechanically coupled to the vehicle by a four bar linkage assembly.

Contemporary snowblade assemblies allow a snowblade to be mounted to a vehicle in order that the vehicle may use the blade to remove or push snow away from a given area. Since the effectiveness of the snow removal is dependent upon the geometric configuration of the blade, many of these past assemblies have allowed the snowblade to define either a forwardly extending pointed geometry (used in deep snow conditions) or a substantially planar geometry (used in light snow conditions).

While these snowblade assemblies have proven to be quite effective in the removal of snow, they suffer from many drawbacks. That is, many of these assemblies have a mechanical structure which extends substantially below the vehicle frame and which is very prone to damage from tree stumps, boulders, and the like which are driven over by the vehicle in the normal course of snow removal. Additionally, this downwardly extending structure has also been prone to being forced or stuck into the ground as the vehicle traverses thereover causing extensive damage to both the blade and the vehicle.

These past snowblade assemblies also have utilized relatively complicated mechanical attachment mechanisms to effect the attachment of the snowblade assembly to the vehicle, and in many instances, have required relatively extensive modification to the vehicle frame. These complicated attachment mechanisms have thusly greatly increased the cost of the snowblade assembly and have made its attachment relatively difficult.

These past snowblade assemblies have further utilized a blade structural support apparatus which has placed the snowblade at a relatively great distance from the vehicle frame. This distance has resulted in the blockage of the normal vehicle headlights and in difficulty in the use of the vehicle in relatively constricted areas. This blockage of the vehicle's headlights has been found to be extremely dangerous when the vehicle is being used in the night and has required the use of special "high mount" headlights with a concomitant increase in cost. Many of these past snowblade assemblies have also provided relatively heavy snowblades which have been difficult to mount upon the vehicle and have caused great weight to be added thereto resulting, in some cases, to structural vehicle frame damage.

It is therefore a primary object of this invention to provide a snowblade assembly which may mount upon a vehicle in substantially the same manner as the vehicle's bumper.

It is another object of this invention to provide a snowblade assembly which is mounted to a vehicle and which defines an amount of ground clearance which is substantially similar to the amount of ground clearance associated with the frame of the vehicle.

It is yet a further object of this invention to provide a snowblade assembly which allows the snowblade to be mounted to the vehicle such that the normal vehicle headlights may be utilized.

It is yet a further object of this invention to provide a relatively lightweight snowblade which is defined by the interconnection of two substantially similar blade segments, wherein the segments are positionally modifiable and co-operative such that the snowblade so defined may be moveable between an outwardly extending pointed or a substantially planar geometric configuration.

It is another object of this invention to provide a snowblade assembly wherein the contained snowblade is normally biased into an active snowplowing position and which is substantially prevented from being driven over by the vehicle.

It is yet a further object of this invention to provide a snowblade assembly having a winch which is connected to the snowblade and which acts to raise and lower the same.

According to the teachings of the present invention, a snowblade assembly is provided having two relatively lightweight and substantially similar blade sections which are removably connected in either a forwardly pointing or a substantially planar geometric configuration.

A single beam is provided which mounts to the vehicle frame in substantially the same manner as the vehicle bumper. The beam includes two boxed end sections wherein two members of a four bar linkage are partially contained within each box section and wherein these members individually pivotally connect to the associated box end section that they reside within in close proximity to the vehicle. Each member of the four bar linkage is also connected to a snowblade support member through separate ball and socket assemblies.

The four bar linkage allows the snowblade to be raised or lowered within a substantially vertical plane with respect to the vehicle and does not extend substantially below the vehicle. The rectangular end boxes limit the amount by which the linkage may be raised or lowered and the interconnection of the linkages to the vehicle frame allows the snowblade to be placed relatively close to the vehicle.

Two of the members that define the four bar linkage contains telescoping members therein. These telescoping members act in concert with the ball and socket assemblies to enable the snowblade to rotate or tilt in response to engagement with a ground surface obstacle.

Springs are provided, each mechanically connecting the snowblade to one of the box sections. These springs serve to bias the snowblade in a normal operative snowplowing position and also serve to return the snowblade to its normal position after it has tilted due to the engagement with a ground surface obstacle.

A winch is also provided and is normally mounted upon the beam and is mechanically connected to the four bar linkage assembly. The winch is normally electronically controlled from the vehicle and acts to raise and lower the snowblade by the application of force upon the four bar linkage.

These and other aspects, features, advantages and objects of this invention will be more readily understood upon carefully reviewing the following detailed description in conjunction with the accompanying drawings and appended claims.

BRIEF DESCRIPTION OF THE DRAWINGS

For a more complete understanding of the present invention and the advantages thereof, reference is now made to the following description taken in conjunction with the accompanying drawings in which like numerals in the various figures refer to the same or similar elements or features.

DETAILED DESCRIPTION OF THE INVENTION

Figure 1:
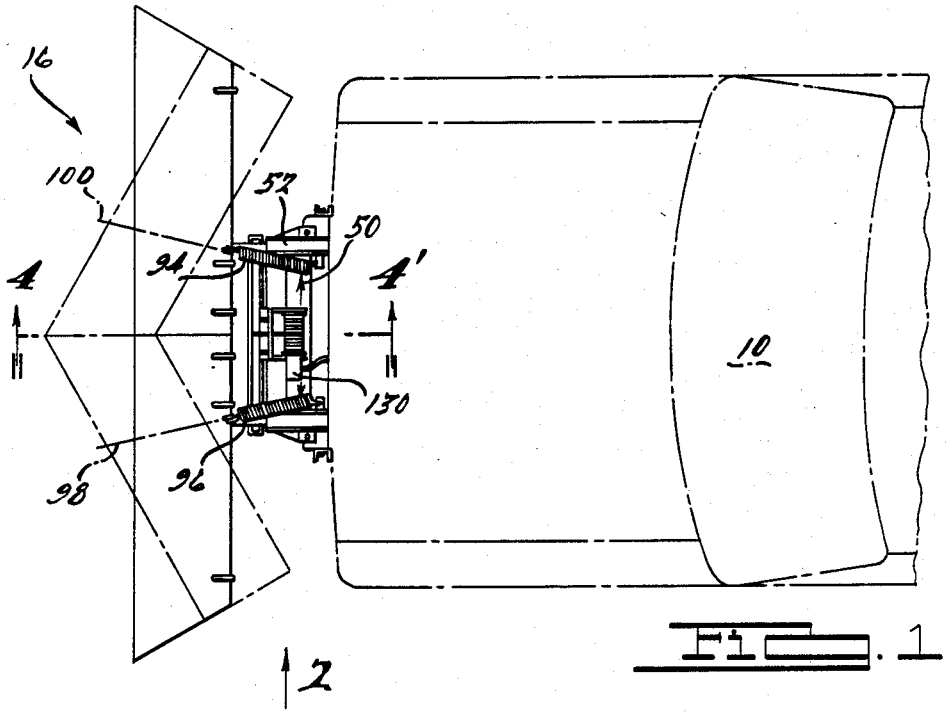
FIG. 1 is a plan view of a snowblade assembly made in accordance with the teachings of the preferred embodiment of this invention.
Figure 2:
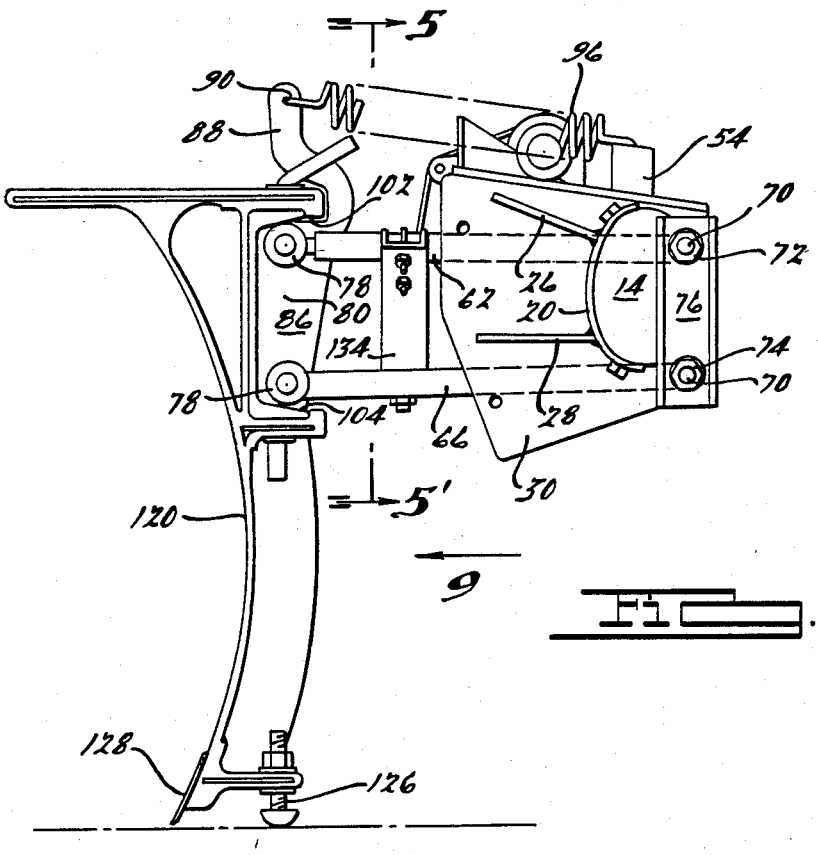
FIG. 2 is a side view of the snowblade assembly shown in FIG. 1 taken substantially in the direction indicated by arrow 2 of FIG. 1.
Figure 5:
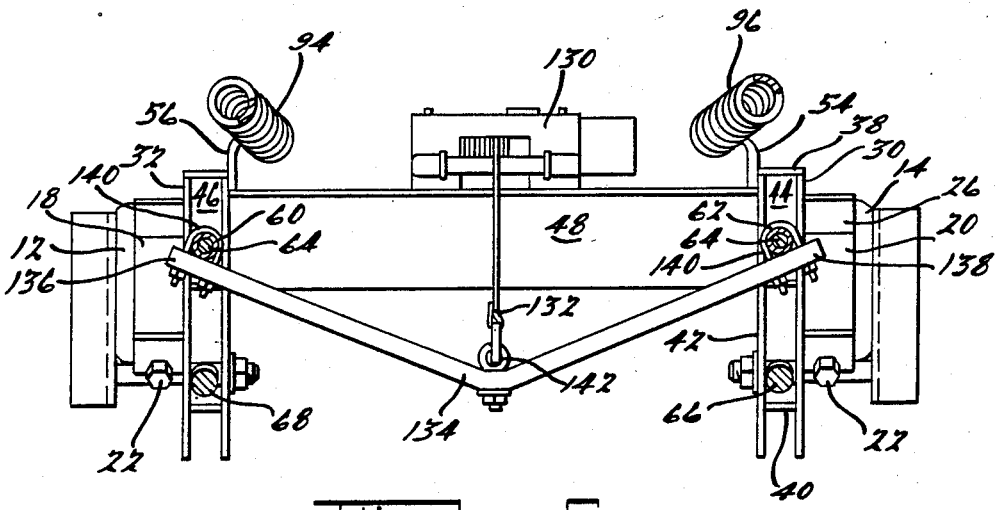
FIG. 5 is a front view of the snowblade assembly taken substantially along line 5–5' of FIG. 2.

Referring now to FIGS. 1, 2 and 5 there is illustrated a typical vehicle 10 having the usual pair of outwardly extending frame rails 12 and 14 to which a snowblade assembly 16 made in accordance with the teachings of the preferred embodiment of this invention is attached. Assembly 16 defines semicircular attachment members 18 and 20 which are attached to rails 12 and 14 respectively in substantially the same manner as was the original bumper (not shown) by placing members 18 and 21 over respective rails 12 and 14 and attaching thereto by use of the usual bumper attachment bolts 22. Thusly, substantially no modification is required to be made upon vehicle 10 due to the attachment of assembly 16 thereon.

Each attachment member 18 and 20 integrally defines outwardly extending metal flange members 26 and 28 which are welded or brazed, in combination with associated member 18 or 20, to a generally planar sidewall member 30 or 32. Each sidewall member 30 and 32 defines openings 34 and 36 therethrough and are further welded or brazed to a generally horizontal top member 38, generally horizontal bottom member 40, and to a second sidewall member 42. Thusly, members go and 37–42 define a linkage containment box 44 while members 32 and 38–42 define a linkage containment box 46.

A hollow rectangular supporting box member 48 is also defined by assembly 16 and is Welded or brazed at opposite ends thereof to separate sidewall members 42 and which has a longitudinal axis of symmetry 50 substantially aligned with the center point 52 of top member 38 in the preferred embodiment of this invention. Box member 48 further integrally defines two vertically extending tabs 54 and 56 at opposite ends thereof and which are each welded or brazed to separate sidewall members 42. Tabs 54 and 56 each define a spring insertion opening 52 therethrough.

Figure 4:
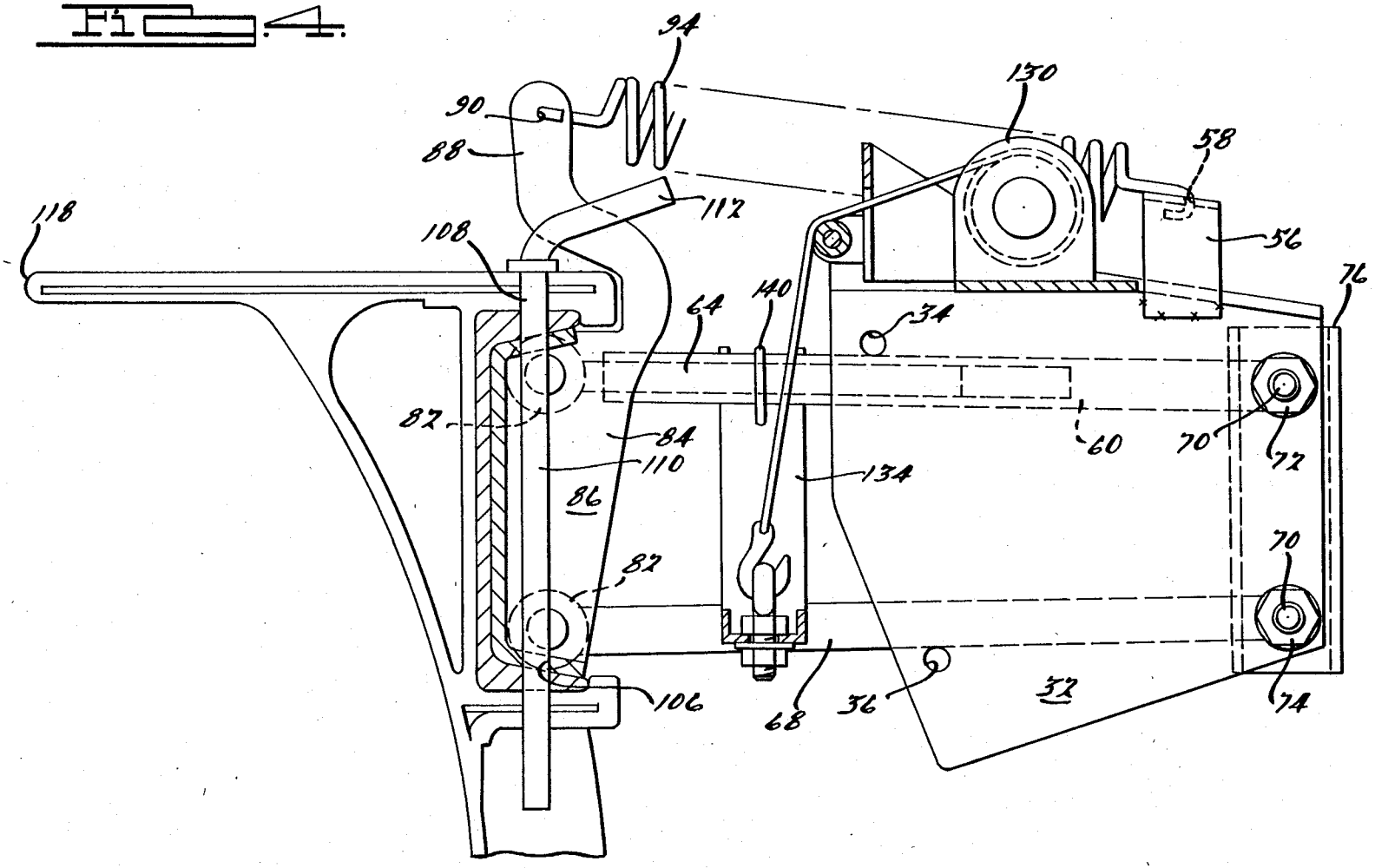
FIG. 4 is a vertical sectional view of the snowblade assembly taken substantially along the line 4–4' of FIG. 1.

As best shown in FIGS. 4 and 5, snowblade assembly 16 further contains a four bar linkage assembly comprised of generally hollow and rounded members 60 and 62 each containing an extendable telescoping portion 44 and two generally solid, rounded members 66 and 68. Members 60–62 and 66–68 have substantially the same geometric cross-sectional area in the preferred embodiment of this invention. Members 62 and 66 are partially housed within and normally extend outwardly (in a substantial horizontal manner) from containment box 44 while members 60 and 62 are partially contained within and also normally extend outwardly in a substantial horizontal manner from containment box 46.

As best shown in FIGS. 2 and 5, members 62 and 66 and 60 and 68 are attached to their respective containment boxes 44 and 46 by use of bolts 70 and nuts 72 and 74. Specifically, each member 60–62 and 66–68 is placed within their respective containment boxes 44 and 46 such that one end associated with each of the members 60–62 and 66–68 is placed in close proximity to the vehicle 10 and such that member 62 is placed above member 66 while member 60 is placed above member 62. The vertical distance between members 60 and 62 is substantially equal to the vertical distance between members 62 and 66.

A channel member 76 is placed in contact with each rail 12 and 14 and a separate bolt 70 is made to horizontally pass through a sidewall member 42, through one of the members 60–62 and 66–68, and then through one of the sidewall members 30 or 32. While passing through channel member 76 each bolt 70 tangentially engages one of the associated rails 12 or 14. Nuts 72 and 74 pivotally secure a separate bolt 70, in the usual manner, to channel 76 and sidewall member 42 respectively. Thusly, members 60–62 and 66–68 are secured within either box 44 or 46 but are free to move vertically within a vertical distance defined by top member 38 and bottom member 40 and are free to move within a horizontal distance defined by end plates 30 and 42 or 32 and 42.

The opposite rounded end of members 62 and 66 are pivotally coupled to sockets 78 defined by planar channel member so while the opposite rounded ends of members 60 and 68 are pivotally coupled to sockets 82 defined by planar channel member 84. In the preferred embodiment of this invention sockets 78 and 82 are substantially similar. The typical ball and socket type of mechanical co-operation of sockets 78 and 82 with members 60–62 and 66–68 along with telescoping portion 64 allows channel members so and 84 to pivotally rotate in the manner shown in FIG. 3 upon engagement of assembly 16 with a ground object (not shown).

Each channel member 80 and 84 defines a vertical planar body portion 86 integrally defining a vertical tab portion 88 having a spring retention opening 90 therethrough. Tabs 88 are aligned with one of tabs 54 and 56 such that spring 94 may be mechanically coupled through openings 58 and 90 associated with the tabs 56 and 88 respectively and that spring 96 may be mechanically coupled through openings 58 and 90 associated with tabs 54 and 88 respectively. Springs 94 and 96 are normally positioned, as shown in FIG. 1 such that they are in direct tangential alignment to the swing axis 98 and 100 respectively defined by the movement of sockets 78 and 82 respectively from a generally planar snowblade geometric configuration to a forwardly extending configuration. This aforementioned tangential spring alignment allows channel members 80 and 84 to easily be made to define a geometric planar geometry or a forwardly pointed "V" geometry as further shown in FIG. 1 since this spring alignment prevents springs 92 and 96 from defining a typical moment arm or torque force which would tend to cause a pushing or pulling of channel members 80 and 84.

Channel members so and 84 also each define a horizontal top member 102 and a horizontal bottom member 104 which are attached at opposite ends thereof and integral to the respective body portion 86 associated therewith. Further, top member 102 and bottom member 104 of each of the channel members 80 and 84 contains a plurality of openings 106 which are in active communication and alignment.

Figure 8:
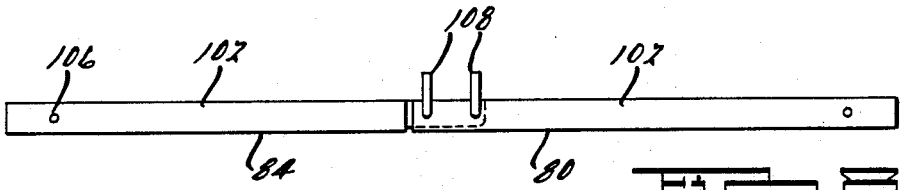
FIG. 8 is a plan view of the channel members shown generally in FIG. 6.

As shown best in FIG. 8, when channel members 80 and 84 define a generally planar geometric configuration, top member 102 of member 80 is made to partially fold over top member 102 of member 84 such that at least two of the respective openings 106 are aligned. In a substantially similar manner, when members so and 84 are in the illustrated planar geometric configuration of FIG. 8, bottom member 104 of channel member 80 partially overlays bottom member 104 of channel member 84 such that openings 106 defined by the overlayed bottom members 104 are aligned and communicating with the openings 106 of partially overlayed members 102. Pins 108 are then individually placed through overlayed and communicating openings 106 defined by overlayed members 104 and 102 such that the generally planar configuration of members 80 and 84 is stabilized.

Each pin 108 has a rounded body portion 110 which is inserted through individual channel member 80 or 84 by means of communicating overlayed openings 106 and has a bent handle portion 112 which contacts top portion 102 of channel portion 80 so as to prevent pin 108 from sliding through openings 106 while stabilizing pin 108 therein.

Figure 7:
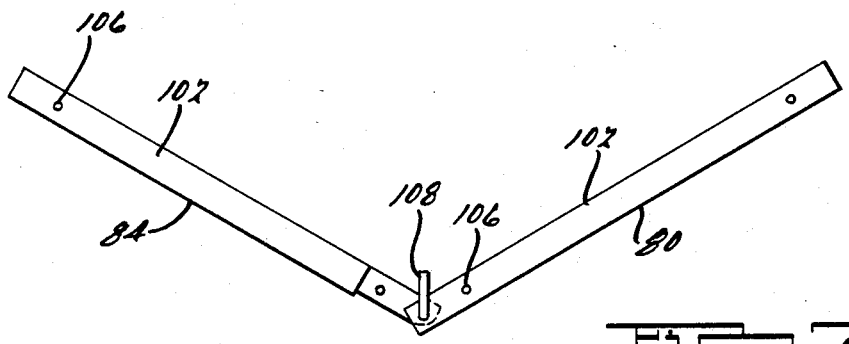
FIG. 7 is a plan view of the channel members shown generally in FIG. 6 but illustrating the channel members as defining a forwardly extending pointed configuration.

In the forwardly extending "V" configuration of FIG. 7, channel members 80 and 84 are moved outwardly from their initial planar position of FIG. 8 by the co-operation of telescoping portion 64 of members 60 and 62 and sockets 78 and 82. In this forwardly extending position, top members 102 of channel member 80 partially overlays top members 102 of channel member 84 such that at least one opening 106 of overlayed members 102 and 104 is aligned. Further in this configuration, bottom member 104 of channel member 80 overlays bottom member 104 of channel member 84 such that at least one opening 106 contained upon portion 104 of member 80 is aligned with at least one opening 106 upon member 104 of channel member 84 and that these overlayed openings are in communication with a unique one of the openings 106 associated with the overlayed members 102. Channel members 80 and 84 are attached together in the usual manner by pins 108 in this forwardly extending "V" configuration at an approximate angle of 30° in the preferred embodiment of this invention.

Snowblade assembly 16 further comprises a pair of substantially identical snowblades 114 and 116 each having an integral and outwardly extending snow deflector portion 118 positioned above a general vertical and concave blade portion 120. Snow deflector portion 118 further extends rearwardly of portion 120 and cooperates with a second horizontally rearwardly extending portion 122 to define a channel receiving cavity 124. Each blade 114 and 116 thusly is made to fit over a single channel 80 or 84. Further, both portions 118 and 122 contain a plurality of openings 123, in communication With and of substantially the same geometric size as openings 106.

Figure 9:
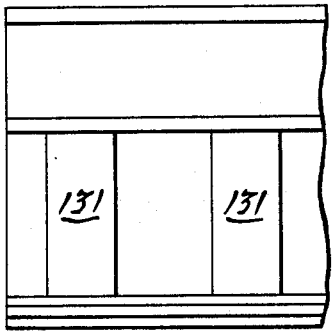
FIG. 9 is a view of the snowblade assembly of the preferred embodiment of this invention taken in the direction of arrow 9 of FIG. 2.

Snowblades 114 and 116 further comprise a bottom and insertable skid shoe portion 126 and a horizontal scraper edge portion 128 both Of which serve the usual functions of increasing the lifespan associated with blades 114 and 116 by providing protection against the abrasive contact with ground objects. Further, blades 114 and 116 also, as best shown in FIG. 9, define a plurality of integrally molded vertical support ribs 130 which act to carry mechanical loadings from the edge portion 128 and skid shoe portion 126 to flange 122 associated With channel 80 or 84. In the preferred embodiment of this invention, blades 114 and 116 are manufactured of composite plastic materials such as fiberglass or graphite fiber making them easily transportable and removable. Further one end of each blade 114 and 116 is mitered to fit together in the forwardly extending "V" mode while the other and opposite end is substantially straight. Therefore, as best shown in FIG. 1, the leftmost blade 116 (relative to the direction facing vehicle 10) associated with the "V" or forwardly extending configuration is the rightmost blade 116 in the straight configuration and the rightmost blade 114 in the "V" or forwardly extending configuration is the leftmost blade 114 in the straight of planar configuration.

As best shown in FIGS. 2, 4 and 5 assembly 16 further comprises a typical electric winch 130 bolted to box member 48 and has its usually electrical connection portion electrically coupled to a source of electrical energy within vehicle 10 (not shown) so as to be under the control of the vehicle 10 driver. Further, winch 130 has the usual hooked-end portion 132 and is connected to member 134 having two end portions 136 and 138. Portions 136 and 138 are mechanically connected to members 60 and 62 respectively by means of a typical mechanical fastener 140. Portion 132 connects to a typical bolt and nut assembly 142 which is fastened to member 134 in the usual manner.

In operation, in non-snowplowing use, blades 114 and 116 may be stored within or upon vehicle lo or in any Other convenient place. Channel members so and 84, in the preferred embodiment of this invention, always remain upon vehicle 10 and allow vehicle 10 to appear as if the standard vehicle bumper was still present and mounted thereon thusly making for a rather aesthetic appearance of vehicle 10. For this non-snowplow mode, bolts 108 are horizontally inserted through one of the openings 34 and 36 defined by end plate members 30 and 32. Thusly, members 60–62 and 66–68 are prevented from rising above a point defined by opening 34 and are prevented from being lower than a point defined by opening 36 and bolts 108 are stored in a known location for future use. These members 60–62 and 66–68 are also prevented from wildly swinging from side to side due to sideplate members 32 and 42 of box 46 and sideplate members 30 and 42 of box 44.

Additionally, since members 60–62 and 66–68 are pivotally attached to boxes 44 and 46 rearward (i.e., close to vehicle 10) of support member 48 and are partially contained within the boxes 44 and 46, the overall length of the distance from vehicle 10 to snowblades 114 and 116 is shortened thusly allowing vehicle 10 to maneuver in relatively close areas and allowing the normal vehicle headlights to be used even when blades 114 and 116 are mounted upon vehicle 10. Further, the use of members 60–62 and 66–68 in the aforementioned four bar linkage manner in co-operation with containment boxes 44 and 46 provides a snowblade 114, 116 support apparatus which does not have structure which substantially hangs down below the vehicle and which may be extremely prone to damage due to its engagement with ground objects.

When it is desired to plow snow, a user of assembly 16 determines an initial configuration to be associated with blades 114 and 116. This configuration is then defined by placing channels 80 and 84 in either a generally planar position as shown in FIG. 8 or in a forwardly extending "V" configuration as shown in FIG. 7.

Blades 114 and 116 are then each fitted over one of the channels 80 or 84 such that a single channel 80 or 84 resides within portion 124 of blade 114 or 116. Each opening 106 of each channel 80 or 84 is then aligned with one of the openings 123 defined upon each blade 114 or 116. Additionally, openings 123 are also aligned with previously defined overlayed openings 106 associated with channels 80 and 84. A single bolt 108 is then placed through each of the aligned openings 123 and 106 in the previously specified manner such that snowblades 114 and 116 are securely fastened upon channels 80 and 84 and these channels 80 and 84 are in a secured desired geometric configuration.

Figure 3:
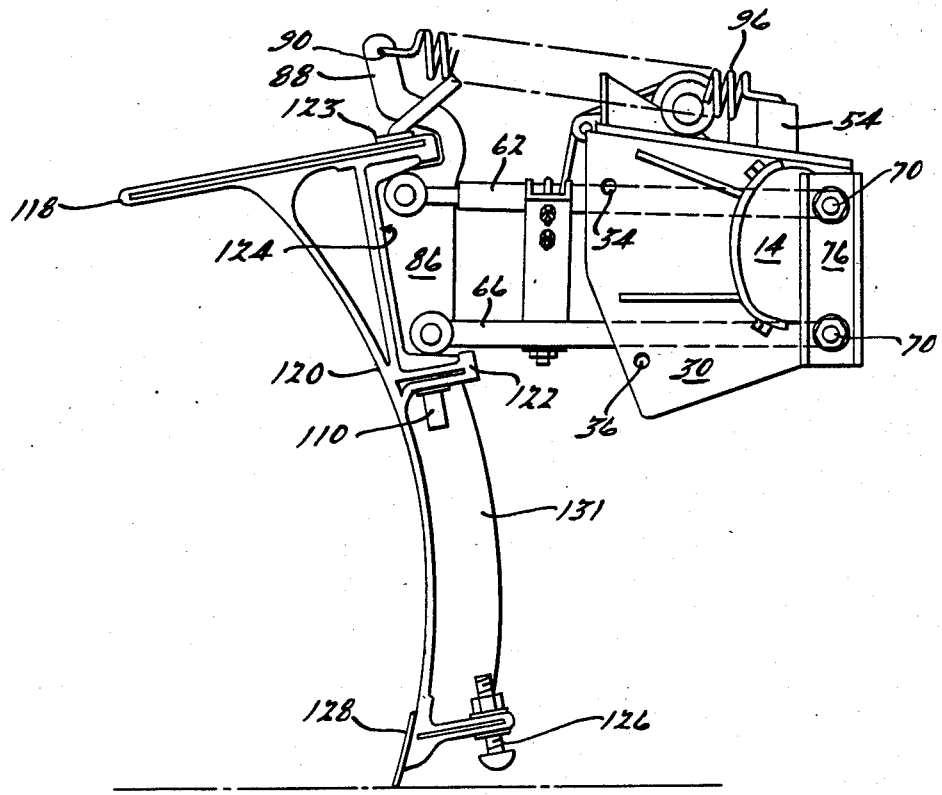
FIG. 3 is a view of the snowblade assembly similar to that shown in FIG. 1 but illustrating the snowblade in a tipped position.
Figure 6:
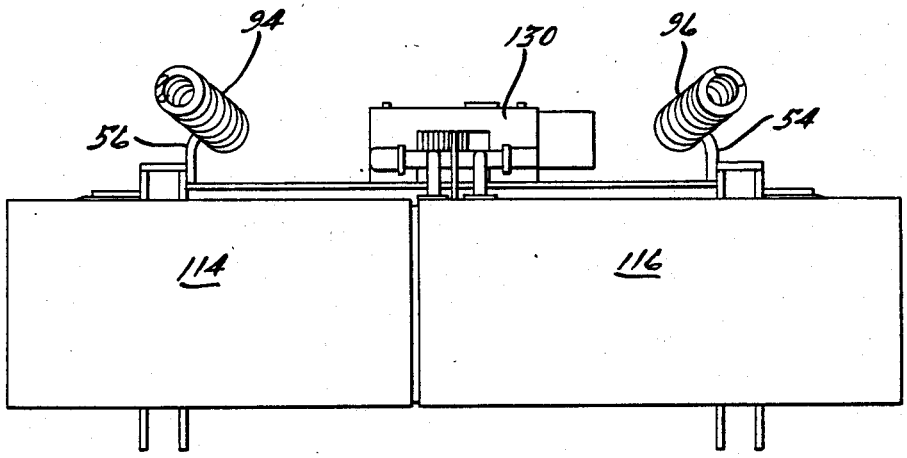
FIG. 6 is a view similar to that of FIG. 5 but showing the channel members in a substantially planar position relative to the attached to vehicle.

In operation, vehicle 10 proceeds to plow snow present within the area and, during this process, may encounter a ground obstruction. Should this occur, as shown in FIG. 3, telescoping portion 64 is automatically extended out of members 60 and 62 and springs 94 and 96 are extended as well. This extension of portion 64 and springs 94 and 96 causes snowblades 114 and 116 to tilt or partially flip downwardly in the manner shown thusly allowing the blades 114 and 116 to pass over the encountered ground obstacle and preventing blades 114 and 116 from being stuck within the ground. Thusly, the possibility of vehicle 10 or assembly 16 damage from driving over one of blades 114 and 116 by vehicle 10 is minimized. After the object has been passed, springs 94 and 96 bias blades 114 and 116 back into the normal operative planar position as shown in FIG. 1.

During this snowplowing operation, it also may become necessary to raise or lower blades 114 or 116. This may be accomplished by electronically controlling winch 130, in the usual manner, to lift member 134 causing horizontal force to be communicated to members 60 and 62 thusly forcing channels 80 and 84 and associated blades 114 and 116 to rise accordingly. Lowering these blades 114 and 116 is accomplished by having the winch 130 lower member 134 in a typical manner. This raising and lowering of channels so and 84 causes blades 114 and 116 to be moved while still being substantially perpendicular to the ground. Plates 38 and 40 prevent blades 114 and 116 to be raised or lowered respectively to such an extent that they will either block the headlights of the vehicle 10 Or cause the vehicle to drive thereover.

Should it become necessary to change the geometric configuration of blades 114 and 116, one simply stops vehicle 10, removes pins 108 and removes blades 114 and 116 while redefining the new geometric configuration of channels 80 and 84 in a manner previously specified. Thereafter, blades 114 and 116 are placed back upon channels 80 and 84 and pins 108 reinserted as hereinbefore discussed.

It is to be understood that the invention is not limited to the exact construction illustrated and described above, but that various changes and modifications may be made without departing from the spirit and scope of the invention as defined in the following claims.

I claim:

1. A snowblade assembly for attaching a snowblade to a motor vehicle, said motor vehicle traveling over a plurality of ground objects wherein, said snowblade engages said ground objects, said snowblade assembly comprising:

channel means moveable between a planar and a pointed position for mounting said snowblade;

four bar linkage means pivotally connected to said channel means for horizontally extending said channel means from said vehicle and for causing said channel means to pivotally rotate upon said engagement of said ground objects by said snowblade;

winch means, connected to said four bar linkage means, for raising and lowering said channel means; and containment means, connected to said vehicle, for partially containing said four bar linkage means and for limiting said raising and lowering of said channel means by said winch means.

2. The snowblade assembly of claim 1 wherein said four bar linkage means comprises:

a first rounded and hollow member having a telescoping tubular portion therein; and a second rounded and hollow member.

3. The snowblade assembly of claim 1 further comprising:

spring biasing means connected to said containment means for stopping said pivotal rotation of said channel means.

4. A snowblade assembly for attachment to a motor vehicle having a bumper connected thereto and traversing a plurality of ground objects, said snowblade assembly comprising:

snowblade means for defining a snowblade, wherein said snowblade engages said ground objects and is normally positioned perpendicular to said ground, said snowblade being moveable between a planar and a pointed position;

channel means, connected to said snowblade means, moveable between a planar and a pointed position for mechanically supporting said snowblade means;

four bar linkage means, pivotally connected to said channel means for extendably positioning said channel means from said vehicle and for causing said channel means to pivotally tilt upon said engagement of said ground objects by said snowblade and for allowing said snowblade means to be raised and lowered while remaining perpendicular to said ground;

containment means connected to said vehicle in substantially the same manner as said bumper, for containing said four bar linkage means and for limiting said raising and lowering of said snowblade means; and spring biasing means connected to said containment means for biasing said snowblade means to said normal perpendicular position after said tilt of said channel means.

5. The snowblade assembly of claim 4 further comprising:

winch means connected to said four bar linkage means for raising said snowblade means.

6. The snowblade assembly of claim 5 further comprising:

winch support means connected to said containment means for supporting said winch means.

7. The snowblade assembly of claim 4 wherein said four bar linkage means comprises:

a first rounded and hollow member having a telescoping tubular portion therein; and a second rounded and hollow member.

8. The snowblade assembly of claim 4 wherein said snowblade means comprises:

a concave body portion defining an integral snow deflector portion thereon and having a skid shoe portion opposite said snow deflector portion.

9. A snowblade assembly for attachment to a motor vehicle having a bumper connected thereto and traversing a plurality of ground objects, said snowblade assembly comprising:

snowblade means for defining a snowblade, wherein said snowblade engages said plurality of ground objects and is normally perpendicular to said ground, said snowblade being moveable between a planar and a pointed position;

channel means connected to said snowblade means and moveable between a planar and a pointed position for mechanically supporting said snowblade means;

four bar linkage means pivotally connected to said channel means for extendably positioning said channel means from said vehicle and for causing said channel means to move between said planar and said pointed position, said four bar linkage means defining an axis of swing upon said movement between said planar and said pointed position and for causing said channel means to pivotally rotate upon said engagement of said plurality of ground objects by said snowblade means and for allowing said snowblade means to be raised while remaining perpendicular to said ground;

winch means connected to said four bar linkage means for raising said snowblade means; and containment means connected to said vehicle in substantially the same manner as said bumper for pivotally mounting said four bar linkage means, said mounting being in close proximity to said vehicle, and for limiting said raising of said snowblade means;

spring biasing means connected to said containment means and having a longitudinal axis of symmetry being in alignment with said axis of swing;

winch support means connected to said containment means for supporting said winch.

10. The snowblade assembly of claim 9 wherein said snowblade means comprises:

a concave body portion defining an integral snow deflector portion thereon and having a skid shoe portion opposite said snow deflector portion.

11. The snowblade assembly of claim 9 further comprising:

means connected to said snowblade means and to said channel means for mounting said snowblade means upon said channel means.

12. The snowblade means of claim 11 wherein said means for mounting comprises:

a plurality of bolts.

13. The snowblade assembly of claim 9 wherein said four bar linkage means comprises:

a first rounded and hollow member having a telescoping tubular portion therein; and a second rounded and hollow member.

* * * * *

UNITED STATES PATENT AND TRADEMARK OFFICE

CERTIFICATE OF CORRECTION

PATENT NO. : 4,907,358

DATED : March 13, 1990

INVENTOR(S) : Thomas S. Moore

It is certified that error appears in the above-identified patent and that said Letters Patent is hereby corrected as shown below:

| | |
|---|---|
| Col. 1, line 59, 60 | No new paragraph starting with "substantially". |
| Col. 3, line 46 | "21" should be --20-- |
| Col. 3, line 60 | "go" should be --30-- |
| Col. 3, line 61 | "37-42" should be --38-42-- |
| Col. 3, line 64 | "Welded" should be --welded-- |
| Col. 4, line 5 | "52" should be --58-- |
| Col. 4, line 10 | "44" should be --64-- |
| Col. 4, line 16 | "62" should be --68-- |
| Col. 4, line 28 | "62" (first occurrence in patent) should be --68-- |
| Col. 4, line 28 | "62" (second occurence in patent) should be --68-- |
| Col. 4, line 48 | "so" should be --80-- |
| Col. 4, line 55 | "so" should be --80-- |
| Col. 5, line 12 | "so" should be --80-- |
| Col. 5, line 25 | "so" should be --80-- |
| Col. 6, line 7 | "With" should be --with-- |
| Col. 6, line 11 | "Of" should be --of-- |
| Col. 6, line 19 | "With" should be --with-- |
| Col. 6, line 47 | "lo" should be --10-- |
| Col. 6, line 48 | "Other" should be --other-- |
| Col. 6, line 48 | "so" should be --80-- |
| Col. 7, line 56 | "so" should be --80-- |
| Col. 7, line 61 | "Or" should be --or-- |

Signed and Sealed this

Twenty-first Day of April, 1992

*Attest:*

HARRY F. MANBECK, JR.

*Attesting Officer*

*Commissioner of Patents and Trademarks*